US005729996A

United States Patent [19]

Barger

[11] Patent Number: 5,729,996

[45] Date of Patent: Mar. 24, 1998

[54] VENTED DRIP TRAY FOR GAS ABSORPTION REFRIGERATORS

[75] Inventor: Jeffrey A. Barger, Sidney, Ohio

[73] Assignee: Norcold, Inc., Sidney, Ohio

[21] Appl. No.: 680,311

[22] Filed: Jul. 11, 1996

[51] Int. Cl.[6] ..... F25D 21/14

[52] U.S. Cl. ..... 62/288; 62/290

[58] Field of Search ..... 62/272, 281, 285, 62/286, 288, 291, 290

[56] References Cited

U.S. PATENT DOCUMENTS

| | | | |
|---|---|---|---|
| 2,045,528 | 6/1936 | Kritzer | 62/290 |
| 2,045,529 | 6/1936 | Kritzer et al. | 62/290 |
| 2,066,817 | 1/1937 | Young | 62/288 |
| 2,095,219 | 10/1937 | Lear | 62/290 |
| 2,268,363 | 12/1941 | Wellington | 62/290 |
| 3,807,189 | 4/1974 | Eber et al. | 62/110 |
| 3,874,193 | 4/1975 | Reistad | 62/490 |
| 4,299,099 | 11/1981 | Myers et al. | 62/256 |
| 4,474,029 | 10/1984 | Kennon | 62/278 |
| 4,776,182 | 10/1988 | Gidseg | 62/448 |
| 4,986,087 | 1/1991 | Sullivan | 62/291 |
| 5,277,035 | 1/1994 | Fristoe et al. | 62/277 |
| 5,284,027 | 2/1994 | Martin | 62/291 |
| 5,456,087 | 10/1995 | Szynal et al. | 62/154 |

*Primary Examiner*—William Doerrler

*Attorney, Agent, or Firm*—Harness, Dickey & Pierce, P.L.C.

[57] ABSTRACT

Providing an elongated vented drip tray having a narrow solid bottom to be used to collect frost as it melts during the defrosting of a gas absorption type refrigerator. The invention is particularly directed at gas absorption type refrigerators because solid drip trays currently used tend to obstruct airflow within the fresh food compartment. Because gas absorption refrigerators rely on natural convection, placing a solid drip tray inside of the refrigerator compartment beneath the cooling fins of the fresh food compartment somewhat inhibits the free flow of air in that compartment. By providing a vented drip tray, airflow throughout the fresh food compartment is not substantially hindered and airflow may actually increase.

8 Claims, 4 Drawing Sheets

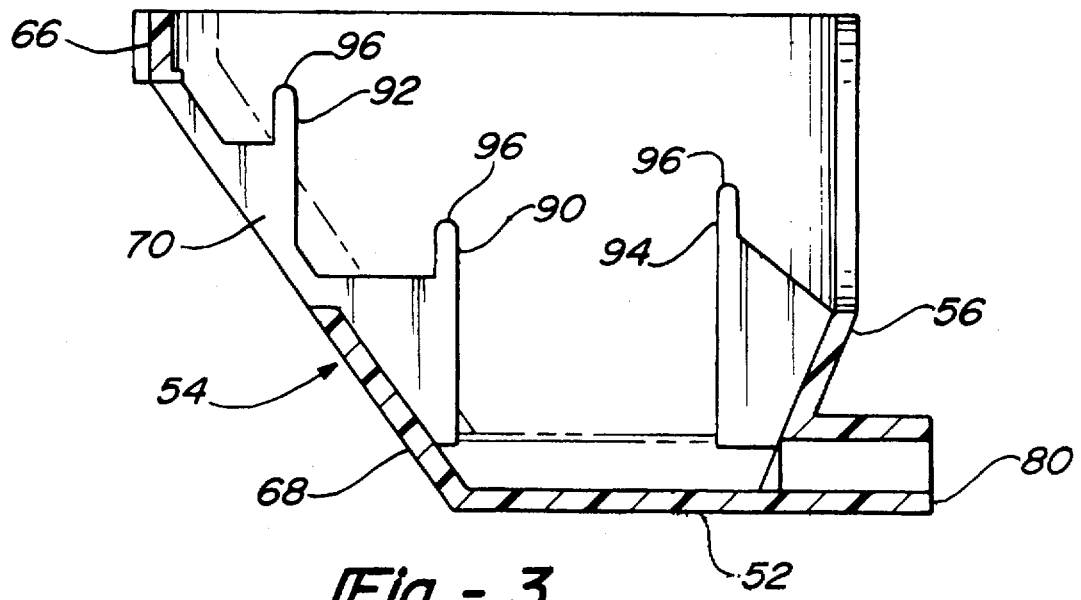
Fig - 3
Fig - 4
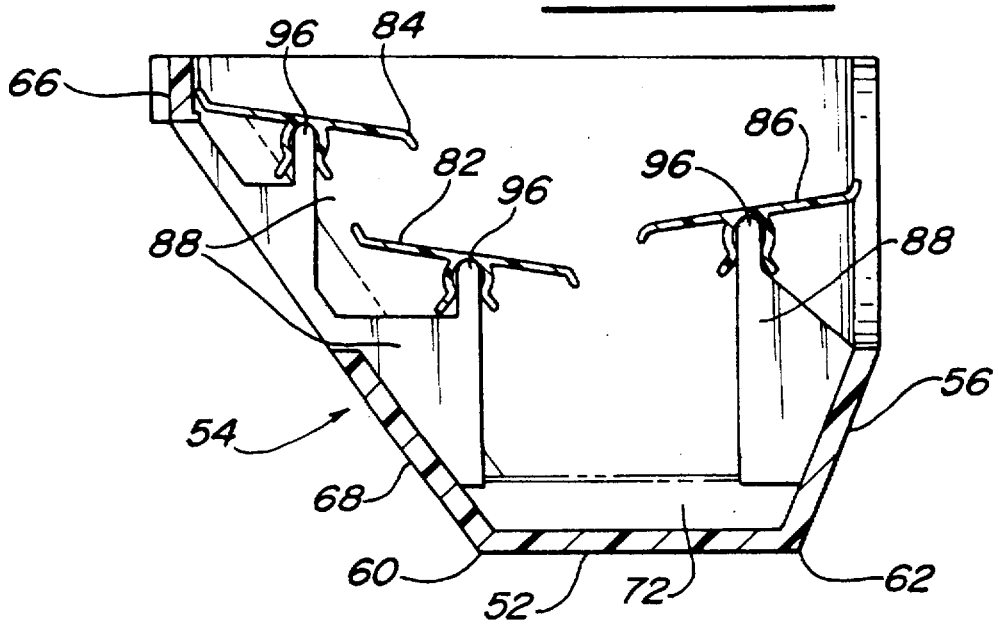

VENTED DRIP TRAY FOR GAS ABSORPTION REFRIGERATORS

BACKGROUND OF THE INVENTION

1. Field of the Invention

This invention pertains to providing a vented drip tray for a gas absorption type refrigerator. The vented drip tray incorporates a series of slots or louvers that promote the movement of air in the fresh food compartment of the refrigerator.

2. Technology Review

Certain gas absorption type refrigerators are capable of operating where no external electrical power source is available and are typically used in recreational vehicles and homes situated at remote locations. When electronic controls are involved to display the refrigerator settings, a twelve volt battery is used. These refrigerators operate by circulating inert gas through and between an evaporator and absorber of an inert gas circuit by a force created by the difference in the specific weights of columns or lines of gaseous fluid. Typically, these refrigerators have evaporator cooling fins that project inwardly into the food compartment from the rear wall of the refrigerator and have drip trays under these fins for collecting and disposing of water that is melted from the fins during defrosting. Air is circulated throughout the food compartment via natural air convection. There is no electric fan in a gas absorption refrigerator to draw air throughout the fresh food compartment.

Evaporator cooling fins, located inside the refrigerator compartment near the top of the fresh food compartment, facilitate this natural air convection. The fins on the evaporator cool air near the top of the fresh food compartment, and the cooled air descends toward the bottom of the compartment. This forces warm air in the bottom portion of the fresh food compartment to rise. Thus, convection currents are created promoting air circulation within the fresh food compartment.

Gas absorption refrigerators are well known in the art, as disclosed for example by U.S. Pat. No. 5,277,035.

During defrost of the refrigerator, melting frost drips into a solid drip tray from which the melted frost flows to an outlet drain. This is known as the drip mode. Generally, gas absorption type refrigerators have drip trays or pans located inside the refrigerator beneath the cooling fins of the fresh food compartment. These drip trays capture the water which results from refrigerator defrosting and include a drain outlet for disposing of the water.

The placement of solid drip trays tend to obstruct the airflow throughout the fresh food compartment. The drip tray is typically placed approximately one-half of an inch to one inch below the cooling fins. Hence, the cool air flowing downwardly from the cooling fins encounters the solid tray such that air flow is at least partially stifled by the drip tray. Much of the initial energy created by the convection air currents, therefore, is lost when the air reaches the drip tray. This reduces the overall cooling efficiency of the refrigerator since natural convection is employed to promote air flow within the fresh food compartment.

SUMMARY OF THE INVENTION

This invention involves providing an elongated vented drip tray, having only a narrow solid bottom to be used to collect water as frost melts during the defrost of the gas absorption type refrigerator. The invention is particularly directed at gas absorption type refrigerators and provides louvers in the drip tray to increase air flow throughout the fresh food compartment. This in turn increases the efficiency of the refrigerator.

By providing a vented drip tray, that is one having slots or louvers, airflow throughout the fresh food compartment is not hindered and may actually increase. The louvered drip tray not only allows the air to retain some of its momentum, but permits the air to be propelled through the vents and across the louvers directing the air throughout the fresh food compartment of the refrigerator.

An objective of this invention is to provide a vented drip tray for use during the defrost of a gas absorption type refrigerator which does not stifle the circulation of air flow throughout the fresh food compartment.

A further objective of the invention is to provide a vented drip tray, which during the defrost of a gas absorption type refrigerator increases the circulation of air flow throughout the fresh food compartment.

An advantage of the invention is simplicity and minimal cost in which the vented drip tray can be implemented without altering the current design of gas absorption type refrigerators.

Another advantage of the invention is that it increases the cooling efficiency of a refrigerator on which the invention is provided.

The above and other objectives and advantages of the invention will be apparent from the following description and drawings and which is characterized in the claims annexed hereto.

BRIEF DESCRIPTION OF THE DRAWINGS

FIG. 3 is a cross sectional view taken along line 3—3 of the drip tray of FIG. 2 with the slats removed.

FIG. 4 shows a sectional view of the vented drip tray taken along line 4—4 of FIG. 2 showing the slats in position.

DETAILED DESCRIPTION OF PREFERRED EMBODIMENTS

Figure 1:
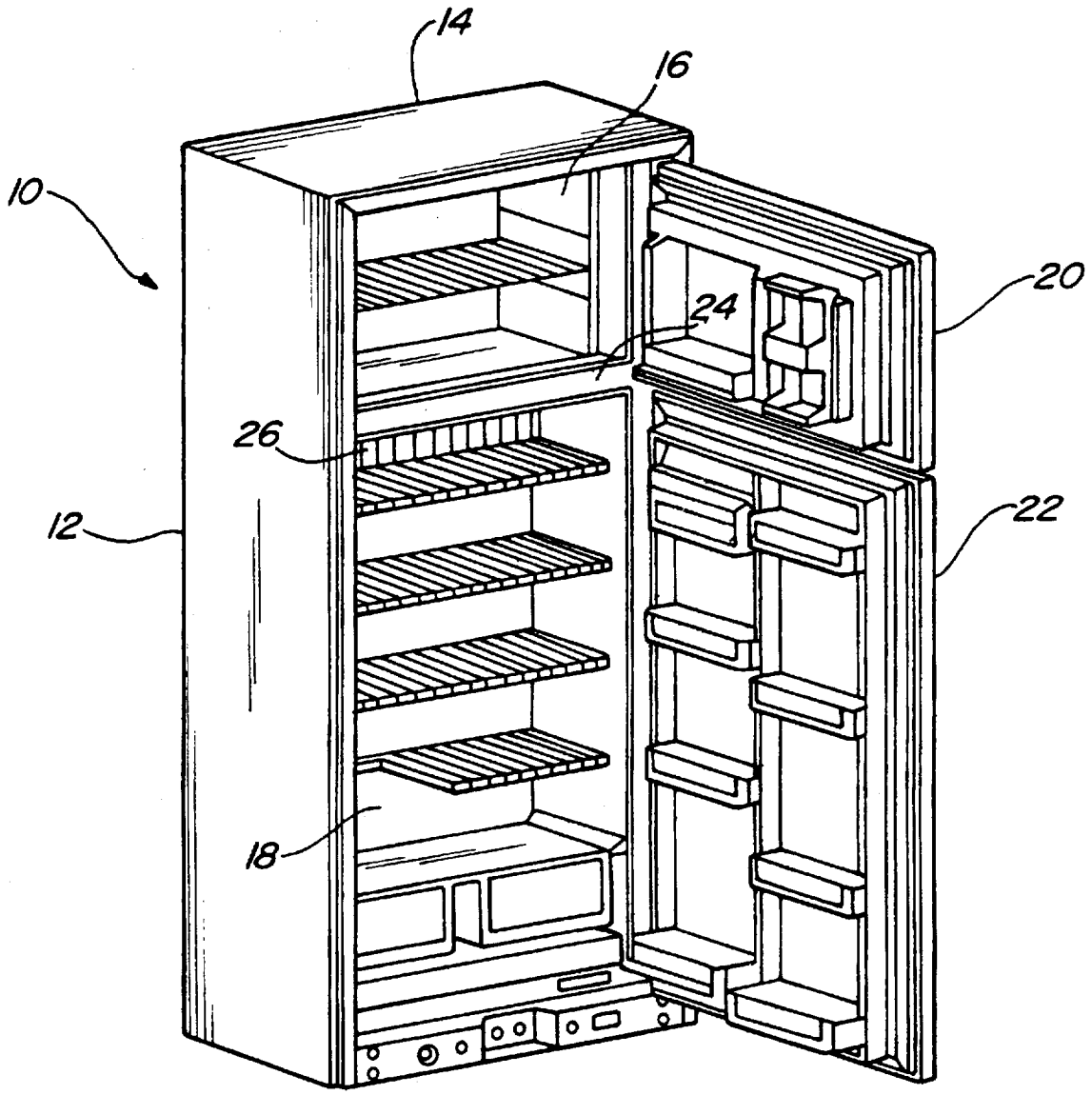
FIG. 1 illustrates a typical multi-compartment gas absorption type refrigerator.

Referring to the drawings, a typical two door refrigerator 10 is shown having a gas absorption refrigeration system 12 (not shown). The refrigerator 10 has a cabinet 14 with a freezer compartment 16 and a fresh food compartment 18, each of which has a door 20 and 22 respectively. A mullion 24 divides the two compartments in the cabinet. The refrigerator 10 has evaporator fins or coils 26 located inside of fresh food compartment 18.

A typical gas absorption refrigeration system 12 is disposed on the rear of the cabinet 14. As disclosed by U.S. Pat. No. 5,277,035, for example, such a system includes a generator, a rectifier, a condenser, an evaporator, an absorber, a leveling chamber, a liquid heat exchanger and the associated liquid lines as well known in the art. The disclosure of U.S. Pat. No. 5,277,035 is incorporated by reference.

The refrigeration system is conventional and forms no part of this invention.

Figure 2:
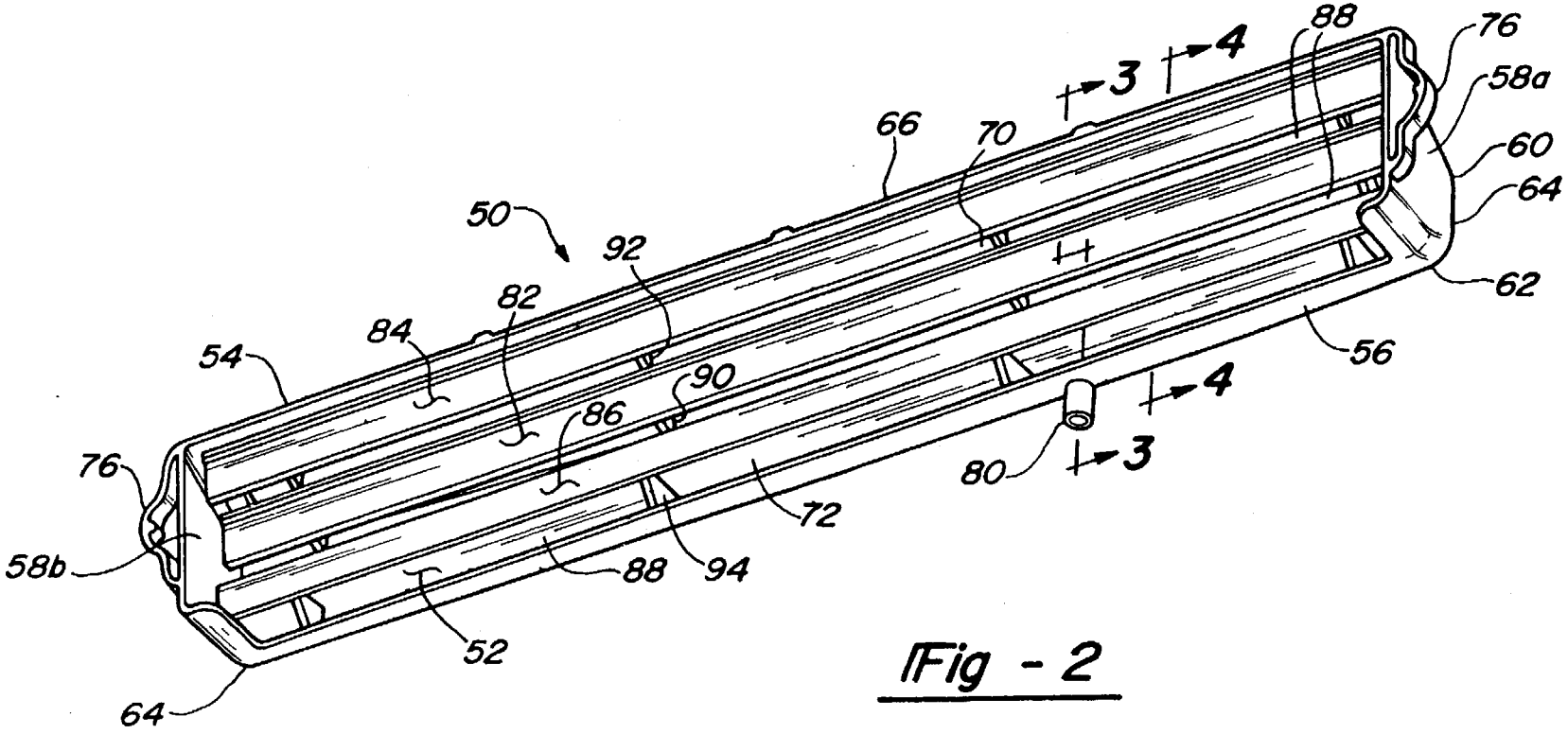
FIG. 2 is a perspective view of the vented drip tray of the invention.

FIG. 2 shows the elongated vented drip tray according to the invention, generally designated 50. Drip tray 50 includes bottom wall 52, front wall 54, back wall 56, and end walls 58*a* and 58*b*. Bottom wall 52 has a front edge 60, back edge 62 and end edges 64. Front wall 54 has a top front rail 66 and a lower portion 68 (FIG. 3) which are separated by an elongated opening 70. End walls 58*a* and 58*b* are substantially perpendicular to bottom wall 52 and extend upwardly from bottom end edges 64. Front wall 54 and back wall 56 angle slightly outwardly and upwardly from bottom wall front edge 60 and back edge 62 respectively. The lower portion 68 of front wall 54 and back wall 56 extend approximately the same height from bottom wall 52 and, along with end walls 58*a*, 58*b* and bottom wall 52 create a receptacle 72 in which water can be collected. Handles 76 located externally on end walls 58*a* and 58*b* provide a means to grip the tray and also to secure drip tray 50 inside of the fresh food compartment of the refrigerator.

As can also be seen in FIG. 2, bottom wall 52 slopes slightly downward from end walls 58*a* and 58*b* to facilitate forcing collected water toward outlet or drain opening 80. Receptacle 72 of drip tray 50 is shallow near end wall 58*a* and becomes progressively deeper as drain opening 80 is approached. Between drain opening 80 and end wall 58*b*, receptacle 72 of the drip tray once again shallows as bottom wall 52 slopes upward from the drain opening to end wall 58*b*.

Vented drip tray 50 also includes a plurality of upstanding projections 90 and 92 along front wall 54 and upstanding projections 94 along back wall 56, as shown in FIGS. 2 and 3, that receive slats 82, 84 and 86, as shown in FIG. 4. The slats 82, 84 and 86 have slots 100 (discussed below and shown in FIGS. 5 and 6) in their undersides for receiving and engaging the projections. Projections 90 are aligned heightwise and extend slightly above the bottom of opening 70 while projections 92 are aligned heightwise and extend almost to the top of opening 70 in front wall 54. Further, projections 90 and 92 are staggered such that when slats 82 and 84 are properly seated on projections 90 and 92 respectively, a step is effectively created. Projections 94 are also aligned heightwise and extend to approximately the same height as projections 90 to receive a slat 86. Projections 90, 92 and 94 are provided with tip 96 sized to fit in the openings of the resilient U-shaped slot 100 (discussed below) of slats 82, 84 and 86. As can be seen in FIGS. 2 and 4, there are slots or gaps 88 between slats 82 and 84, between the lower portion 68 of front wall 54 and slat 82 and between back wall 56 and slat 86. These gaps create "vents" for air to flow throughout drip tray 50.

Figure 5:
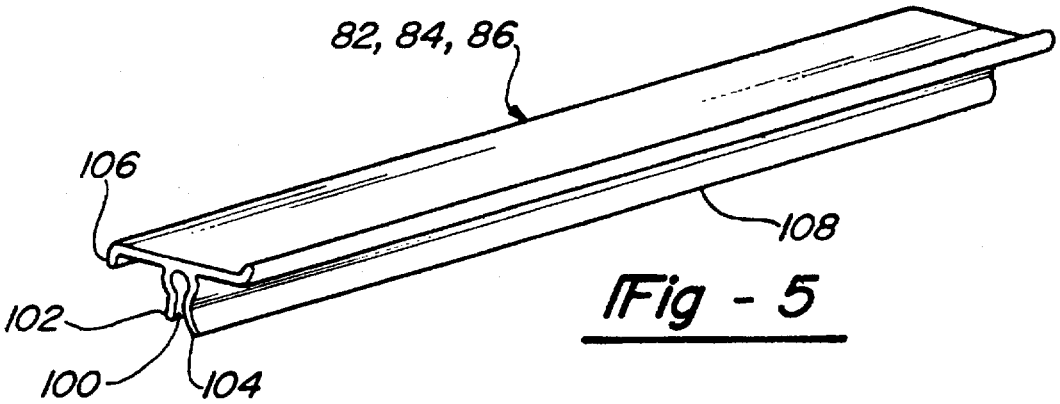
FIG. 5 shows a perspective view of one slat of the vented drip tray.
Figure 6:
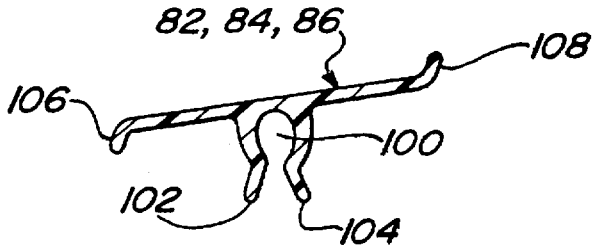
FIG. 6 shows a traverse vertical cross sectional view of a slat of the vented drip tray.

Slats 82, 84 and 86 are identical and are shown in FIGS. 5 and 6. Each slat is provided a resilient U-shaped slot 100 on its underside formed by a pair of integral ribs or legs 102 and 104 that extend lengthwise on the slat and is shown to extend the entire length of the slat. These ribs snap onto projection tips 96 of projections 90, 92 and 94 respectively. Slats 82, 84 and 86 each have an inner edge 106 and an outer edge 108. Inner edges 106 roll downwardly such that as water drips onto the slats it is directed toward the receptacle 72 of drip tray 50. Outer edges 108 turn upwardly to direct water away from flowing outside of drip tray 50. When in position (FIG. 4), the slats are angled horizontally such that the inner edge of each slat is slightly lower than the outer edge. This facilitates directing the water toward the receptacle 72 of drip tray 50.

Figure 7:
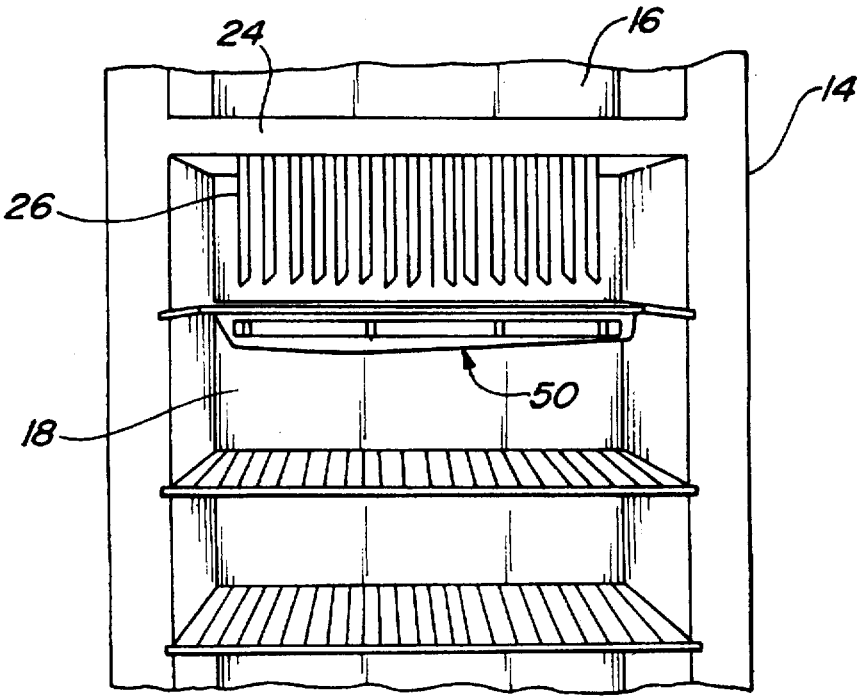
FIG. 7 shows the vented drip tray in position inside a schematic portion of the fresh food compartment of a gas absorption refrigerator.

FIG. 7 shows vented drip tray 50 positioned inside of the fresh food compartment of a gas absorption refrigerator. The drip tray sits approximately one-half of an inch to one inch below the cooling fins. The top edge of the back wall 56 of the drip tray can be positioned flush against or up to approximately one-sixteenth of an inch away from the back wall of the refrigerator.

As stated above, the vented drip tray promotes increased air flow within the fresh food compartment. Simulated testing has shown that when no drip tray is used, convection currents come off the fins and travel down the back wall of the refrigerator to the bottom of the fresh food compartment. With a solid drip tray, the air currents lose momentum when encountering the tray and then spill over the front wall of the tray. The air currents then travel down the back wall of the refrigerator. The vented drip tray, however, not only allows the air to retain some of its initial momentum from the fins but allows the air to be propelled through the vents and across the louvers, which directs the air throughout the fresh food compartment. Testing has shown that this increased air flow results in improved cooling efficiency in not only the fresh food compartment but also in the freezer of gas absorption refrigerators.

Tests were run to evaluate the effect that using the vented drip tray had on the temperature inside both the fresh food compartment and the freezer of a gas absorption refrigerator. A no load A. G. A. Test Enclosure, which is a box built to simulate the installation in a recreational vehicle or motor home, was used for the testing. For purposes of this application, no load means that no food was placed inside of the enclosure for the simulation. The tests were performed under ambient temperature of 90° and the maximum thermostat settings available were used on the refrigeration system. The tests indicate that the vented drip tray stimulated a different air pattern flow than the currently used solid drip tray, surprisingly, resulting in lower temperatures in both the fresh food compartment and the freezer of the gas absorption refrigerator. At 90° F. ambient, the temperature inside of the fresh food compartment of the system using the vented drip tray was measured at 2.5° F. lower than that of the system using a solid drip tray. The freezer compartment had a difference of 0.7° F. most likely resulting from a drop in temperature of the upper air mass in the fresh food compartment. Thus by changing from a solid drip tray to a vented drip tray in accordance with the invention, an increase in cooling efficiency throughout the entire refrigeration system can be realized.

Having described the presently preferred embodiments, it is to be understood that the invention may be otherwise embodied within the scope of the appended claims.

What is claimed is:

1. A vented drip tray for placing beneath evaporator fins of a refrigerator, said drip tray comprising:

an elongated receptacle having a front wall provided with at least one elongated opening therethrough that permits air to flow through the tray and a plurality of integral elongated upstanding projections; and at least one elongated slat having an underside provided with a slot extending the entire length of the underside for attaching to said upstanding projections, said projections located such that when said slat is attached to said projections, said slat directs water which descends from said evaporator fins into said receptacle.

2. A vented drip tray for placing beneath evaporator fins in a refrigerator, said drip tray comprising:

a bottom wall having a front edge, a back edge and two end edges;

a front wall projecting upwardly and outwardly at an obtuse angle relative to said bottom wall and having at least one opening therethrough for the passage of air;

a back wall extending upwardly from and adjacent to the back edge of said bottom wall;

a pair of end walls, said end walls extending upwardly from and substantially perpendicular to the end edges of said bottom wall such that the bottom wall, said front wall, said back wall and said pair of end walls form a receptacle for collecting water;

a plurality of upstanding projections integral to said receptacle; and at least one slat having an underside provided with a slot extending the entire length of the underside for attaching to said upstanding projections, said projections located such that when the slat is attached to said projections, said slat directs water descending from said evaporator fins into said receptacle.

3. A vented drip tray as set forth in claim 2 which further includes an outlet located in said receptacle to drain water from said receptacle.

4. A vented drip tray as set forth in claim 3 in which said bottom wall slopes downward from each said end wall, said drain opening located such that said sloped bottom walls forces said water toward said drain opening.

5. A vented drip tray as set forth in claim 2 in which said slat further has an inner edge and an outer edge, said inner edge being curved downwardly such that water descending to said slat is directed toward said receptacle and said outer edge is curved upwardly to direct water away from flowing to locations outside of said drip tray.

6. A vented drip tray as set forth in claim 5 in which said slat is positioned horizontally such that said inner edge of each slat is slightly lower than said outer edge to facilitate forcing said water toward said receptacle.

7. A vented drip tray as set forth in claim 2 in which said tray further comprises a means to secure said tray beneath said evaporator fins.

8. A refrigerator comprising:

a cabinet having a fresh food compartment and a freezing compartment;

a gas absorption refrigeration system that includes evaporator fins located inside of said fresh food compartment; and a vented drip tray located beneath said evaporator fins, said tray having a bottom wall, front and back walls and end walls extending between the ends of said front and back walls to form a receptacle for collecting water, said front wall projecting upwardly and outwardly at an obtuse angle relative to said bottom wall and having at least one opening therethrough for the flow of air, and at least one slat overlying and spaced from said opening to direct water which descends from said evaporator fins into said receptacle and away from said opening.

* * * * *